US008727832B2

(12) United States Patent
Guo et al.

(10) Patent No.: US 8,727,832 B2
(45) Date of Patent: May 20, 2014

(54) SYSTEM, METHOD AND APPARATUS FOR ENHANCED CLEANING AND POLISHING OF MAGNETIC RECORDING DISK

(75) Inventors: Xing-Cai Guo, Tracy, CA (US); Ferdinand Hendriks, Morgan Hill, CA (US); Toshiki Hirano, San Jose, CA (US); Thomas E. Karis, Aromas, CA (US); Bruno Marchon, Palo Alto, CA (US)

(73) Assignee: HGST Netherlands B.V., Amsterdam (NL)

( * ) Notice: Subject to any disclaimer, the term of this patent is extended or adjusted under 35 U.S.C. 154(b) by 303 days.

(21) Appl. No.: 13/246,101

(22) Filed: Sep. 27, 2011

(65) Prior Publication Data

US 2013/0078890 A1 Mar. 28, 2013

(51) Int. Cl.
*B24B 1/00* (2006.01)

(52) U.S. Cl.
USPC ..... 451/28; 451/41; 451/57; 15/1.51

(58) Field of Classification Search
USPC ..... 451/28, 41, 57, 66, 67, 63, 168, 444, 451/448; 15/1.51; 204/192.11
See application file for complete search history.

(56) References Cited

U.S. PATENT DOCUMENTS 2,920,987 A * 1/1960 Lionel et al. ..... 134/1
4,347,689 A * 9/1982 Hammond ..... 451/63
4,412,400 A * 11/1983 Hammond ..... 451/163
4,744,833 A 5/1988 Cooper et al.
4,930,259 A * 6/1990 Kobylenski et al. ..... 451/303
5,209,027 A * 5/1993 Ishida et al. ..... 451/41
5,223,304 A * 6/1993 Yasuda et al. ..... 427/129
5,350,428 A * 9/1994 Leroux et al. ..... 29/25.01
5,421,901 A 6/1995 Whitney et al.
5,471,443 A * 11/1995 Jamail et al. ..... 369/30.27
5,500,969 A * 3/1996 Bonislawski, Jr. ..... 15/1.51
5,584,938 A * 12/1996 Douglas ..... 134/1.3
5,599,590 A * 2/1997 Hayashi et al. ..... 427/448
5,645,471 A * 7/1997 Strecker ..... 451/59
5,738,906 A * 4/1998 Momose et al. ..... 427/131

(Continued)

FOREIGN PATENT DOCUMENTS

JP 61151839 A 7/1986
JP 62107485 A 5/1987
JP 1106335 A 4/1989
JP 11161946 A 6/1999

(Continued)

OTHER PUBLICATIONS

Anonymous; "Grounded Fixed Abrasive Tape for Processing of Rigid Disk Magnetic Media", Research Disclosure; Nov. 1996; Kenneth Mason Publications Ltd; 3 pages.

(Continued)

*Primary Examiner* — George Nguyen

(57) ABSTRACT

Cleaning or polishing magnetic recording media (MRM) may comprise mounting and rotating the MRM on a spindle; circulating a tape adjacent to a surface of the MRM; and applying an electrostatic (ES) voltage to the tape and attracting particles located on the MRM to the tape. The ES voltage may apply an ES load to the tape to force the tape into contact with the surface of the MRM. No mechanical load may be applied to the tape to force the tape into contact with the surface of the MRM. Additionally, a mechanical load may be applied to the tape to force the tape into contact with the surface of the MRM.

23 Claims, 6 Drawing Sheets

(56) References Cited

U.S. PATENT DOCUMENTS

| | | | | |
|---|---|---|---|---|
| 5,793,584 | A * | 8/1998 | Knight et al. | 360/133 |
| 5,944,585 | A * | 8/1999 | Nagahara et al. | 451/56 |
| 6,074,284 | A * | 6/2000 | Tani et al. | 451/57 |
| 6,103,339 | A * | 8/2000 | Lin et al. | 428/141 |
| 6,660,227 | B2 * | 12/2003 | Lopez Ordaz | 422/24 |
| 6,905,752 | B1 * | 6/2005 | Ebihara et al. | 428/90 |
| 7,799,138 | B2 * | 9/2010 | Fontejon et al. | 134/1.1 |
| 2003/0021723 | A1 * | 1/2003 | Lopez Ordaz | 422/24 |
| 2003/0188766 | A1 * | 10/2003 | Banerjee et al. | 134/7 |
| 2006/0222897 | A1 * | 10/2006 | Kamata et al. | 428/826 |
| 2009/0166184 | A1 * | 7/2009 | Zhou et al. | 204/192.11 |
| 2010/0258144 | A1 * | 10/2010 | Broz et al. | 134/6 |
| 2011/0303553 | A1 * | 12/2011 | Inman et al. | 205/659 |

FOREIGN PATENT DOCUMENTS

| | | | |
|---|---|---|---|
| JP | 2001101653 | A | 4/2001 |
| JP | 2001357514 | A | 12/2001 |
| JP | 2008135091 | A | 6/2008 |
| WO | 98/28101 | A1 | 7/1998 |

OTHER PUBLICATIONS

Meech; "Industry Application Guide: Packaging Industry, Static Solutions to Improve Production and Profitability", Meech Static Eliminators Ltd 2009; 12 pages.

Zhong-Fu, Xia et al.; "Charge Dynamics in Mylar Films Corona-charged at Various Temperatures", IEEE Transactions on Electrical Insulation, vol. 27, No. 4, Aug. 1992; pp. 702-707.

* cited by examiner

SYSTEM, METHOD AND APPARATUS FOR ENHANCED CLEANING AND POLISHING OF MAGNETIC RECORDING DISK

BACKGROUND OF THE INVENTION

1. Field of the Disclosure

The present invention relates in general to disk drives and, in particular, to a system, method and apparatus for the enhanced cleaning and polishing of magnetic recording disks for disk drives.

2. Description of the Related Art

Magnetic recording disks are polished as part of the manufacturing process. The quality of cleaning and polishing determines the viability of a magnetic disk product by providing a sufficient product yield for an acceptable value added. Particles that are on the incoming disk are removed to avoid scratching the disk during polishing. Particles formed from asperities and by overcoat wear are also removed. Particles that remain on the disk after polishing interact with the glide test slider and are detrimental to disk yield and manufacturing throughput. Thus, improvements in the cleaning and polishing of magnetic recording disks prior to assembly in hard disk drives continue to be of interest.

SUMMARY

Embodiments of a system, method and apparatus for cleaning or polishing magnetic recording media (MRM) are disclosed. One embodiment of a method may comprise mounting and rotating the MRM on a spindle; circulating a tape adjacent to a surface of the MRM; and applying an electrostatic (ES) voltage to the tape and attracting particles located on the MRM to the tape. The ES voltage may apply an ES load to the tape to force the tape into contact with the surface of the MRM. In some embodiments, no mechanical load is applied to the tape to force the tape into contact with the surface of the MRM. In other embodiments, a mechanical load may be additionally applied to the tape to force the tape into contact with the surface of the MRM.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Embodiments of a system, method and apparatus for cleaning and polishing of magnetic recording disks prior to assembly in hard disk drives are disclosed. Some embodiments provide enhanced particle removal during the final tape polishing (FTP) process, or during other intermediate steps of manufacture. An electrostatic charge imparted to the support film of the polishing or cleaning tape increases the attractive force between undesirable particles and the tape. The electrostatic charge may be induced in the tape by an electrostatic generator with minimal alteration of conventional manufacturing processes with a commercially available electrode.

Presently some of the particles on incoming disks are removed by a wiping tape pass which is done before the polishing pass. The wiping tape may comprise a non-abrasive particle composite binder on a MYLAR® film support. The wiping tape removes large particles but adds very small particles to the disk surface. Hard particles often form scratches in the disk while being removed during the wipe pass across the rotating disk.

More particles are removed from the disks during the polishing process. The polishing tape abrasive composite topography comprises conventional Benard cells, which are typically concave recesses in the tape that are about 100 μm in diameter and about 5 μm in depth.

Figure 1:
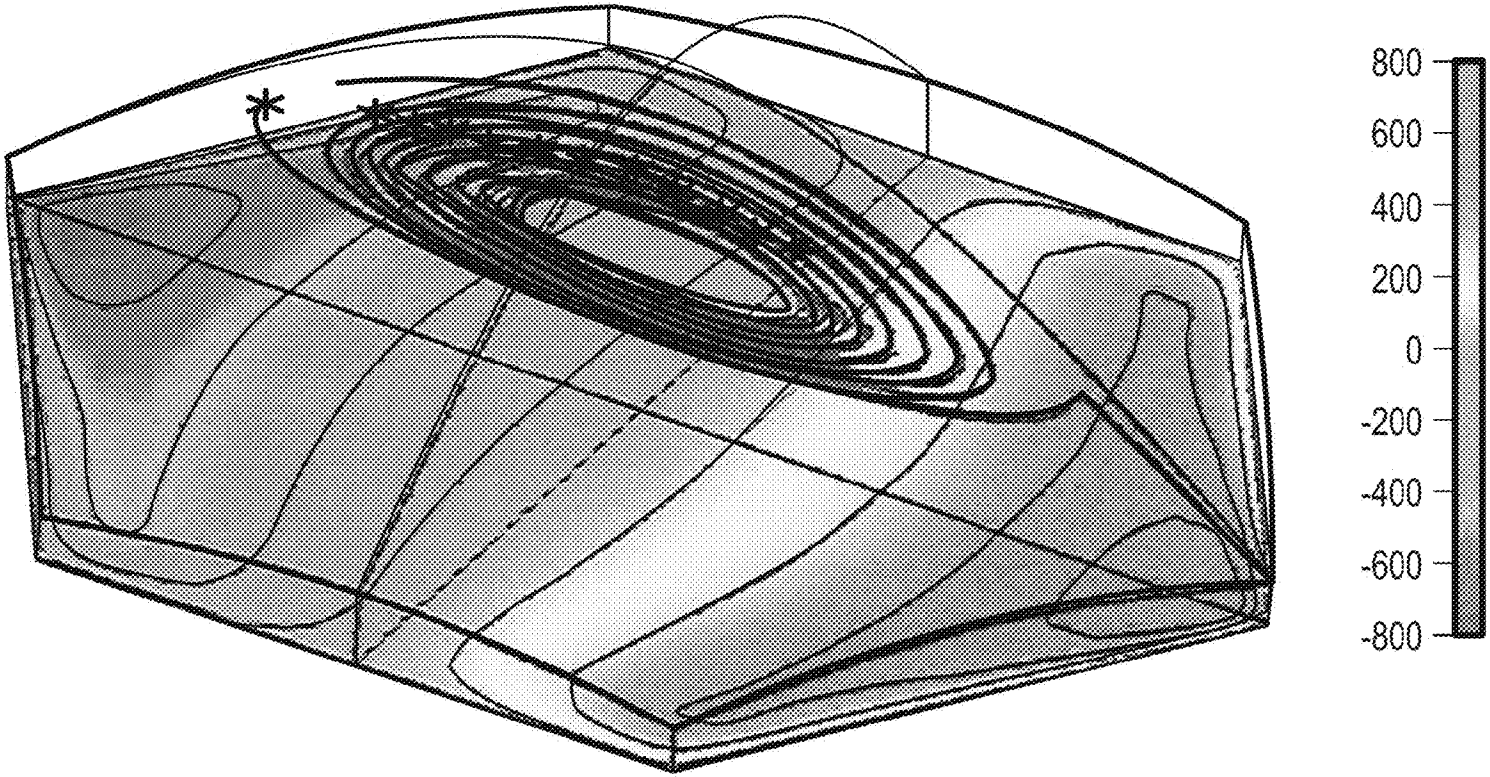
FIG. 1 is a finite element model of a Benard cell in a polishing tape.

Airflow into the Benard cells acts to lift particles from the disk and into a recirculation zone within the concave region. The recirculation zone is shown in a finite element model of the Benard cell in FIG. 1. A particle is lifted from the disk at the entrance to the Benard cell by the suction pressure and entrained in the recirculation flow. Once in the recirculation zone, the particle is brought into close proximity to the tape binder within the Benard cell. The particle is transported from the recirculation streamline and becomes attached to the tape binder surface by electrostatic force. The film support has some inherent charge, which weakly attracts particles. The embodiments disclosed herein enhance the natural electrostatic attractive force between the polishing tape and the particles by external application of electrostatic charge from an electrostatic generator and electrode near the polishing tape during the polishing sweep pass.

In addition to the particles on the disks that are incoming to the polishing process, particles are generated from the disk surface during the polishing process. These tribologically-formed particles include flakes of carbon overcoat, carbon overcoat surface wear debris, and metallic spit particles formed during sputtering from a target. Electrostatic-enhanced cleaning of the disk applies equally well to particles formed in-situ during the polishing process. The problem of overcoat wear debris formed in-situ during polishing increases in severity as the lubricant and overcoat thickness are decreased to improve the soft error rate (SER).

Manufacturing yield is lost and throughput is decreased when particles remain on the disk after polishing. Further disk yield and hard disk drive (HDD) yield is lost to scratches made by hard particles on the disks during wiping and polishing. The electrostatic enhancement of particle removal during polishing significantly reduces the number of particles remaining after disk polishing. This also reduces the probability that a particle remains adhered to the disk instead of being picked up on the tape.

Removal of loosely attached particles from disk substrates after wash and just prior to sputtering is similarly enhanced to decrease the occurrence of so-called pre-sputter defects.

Hard particles on disks in the patterned media process also decrease yield through tenting of the photoresist. Tenting is caused by the formation of a non-uniform spacing gap in the photoresist thickness between the rigid disk and the template. Removal of loose particles from disks after sputter and before nanoimprint lithography is enhanced by application of an electrostatically charged cleaning tape.

Some embodiments of the polishing and cleaning tape may comprise a MYLAR® substrate or film having a thickness of about 25 to 50 μm. The thickness of the binder on the substrate may have a thickness of about 7 to 10 μm. The width of the tape may be about ⅜ of an inch. Normally the binder side of the tape is pressed onto the surface of the spinning disk by a soft elastomer or elastomeric pad under a load applied to the back side of the substrate portion of the tape. The electrostatically enhanced polishing and cleaning process may be implemented by application of an electrostatic charge to the substrate backing of the tape binder. In some cases the electrostatic force between the tape and the disk is comparable to conventional external loading forces.

In some embodiments, the electrostatic charge may be applied to the tape by an electrostatic generator and an electrode. This equipment may be used for electrostatic enhanced polishing and cleaning of disks by incorporating it with conventional manufacturing processes.

Figure 2:
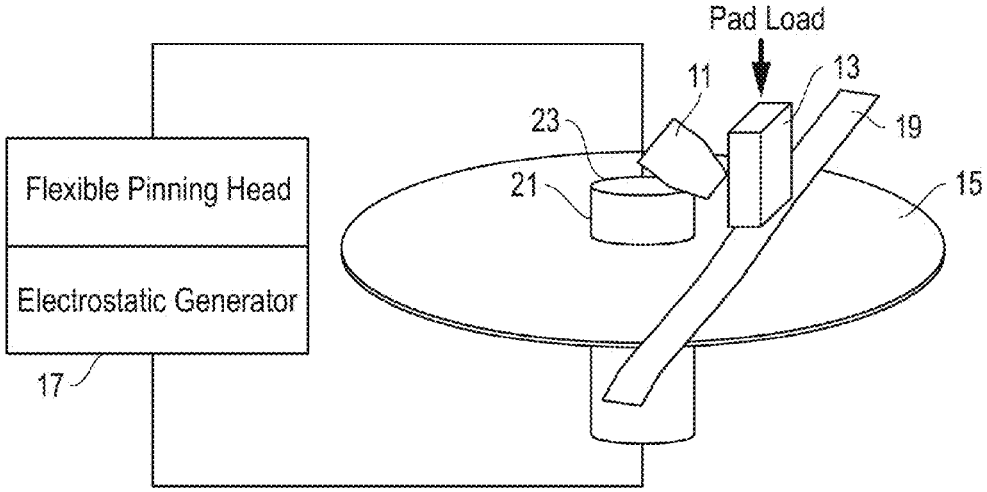
FIGS. 2 and 3 are embodiments of electrostatically enhanced cleaning and/or polishing technique.

For example, a schematic diagram of an electrostatic (ES) enhanced cleaning and polishing process for magnetic recording disks is shown in FIG. 2. A flexible electrode 11 is brought near a region of tape loading by the pad 13. The electrode may comprise, for example, a Meech 995v3. The disk 15 is electrically grounded to the electrostatic generator 17 through the motor mount and the spindle bearing. The electrostatic generator may comprise, for example, a Meech 992v3-30-P.

Figure 3:
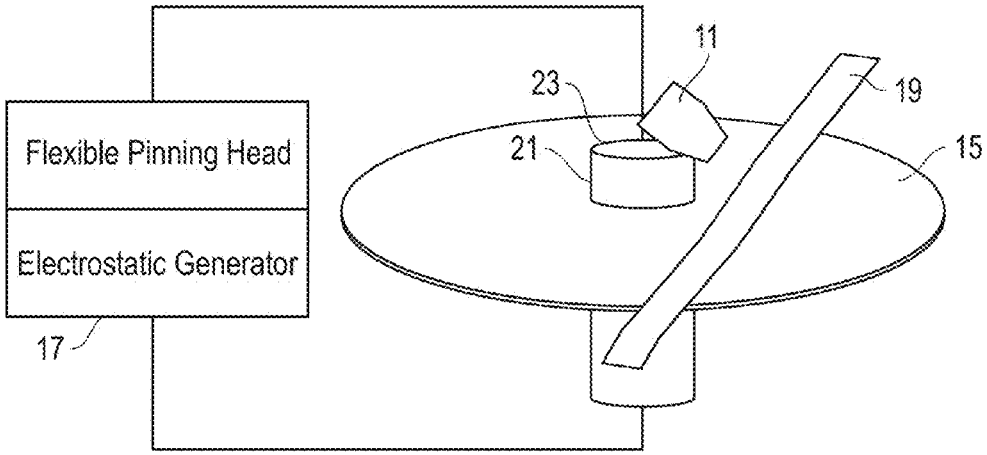

An external loading configuration is shown in FIG. 2, and a self-loading configuration is shown in FIG. 3. The external loading configuration may include the pad and load beam for applying a load to the tape 19 as described elsewhere herein. In the self-loading configuration of Example 1, the pad and load are not used. The disk spindle cap 21 and bolt 23 may be formed from an insulating material (e.g., nylon) to avoid grounding the electric field of the electrode 11. To avoid dwell, radial translation of the tape may be started before the pad load or the ES voltage is applied by the electrode 11.

Example 1

Self-Loading Configuration

In this example, the disk cleaning and polishing tape is demonstrated in the self-loading configuration. There is no externally applied load as shown in FIG. 3. The conventional pad and load beam from the air cylinder are removed from the assembly. The tape load is provided by the ES force of the charge on the substrate or film. The disk rotation rate was about 2000 rpm and the ES voltage was about 8 kV. Two disks were contaminated by exposure to unfiltered ambient air in a nonconductive polycarbonate cassette. A third disk had a low level contamination formed by two polishing passes and using a thin layer of lubricant (e.g., about 0.2 nm of ZTMD) without ES enhanced cleaning.

Figure 4A:
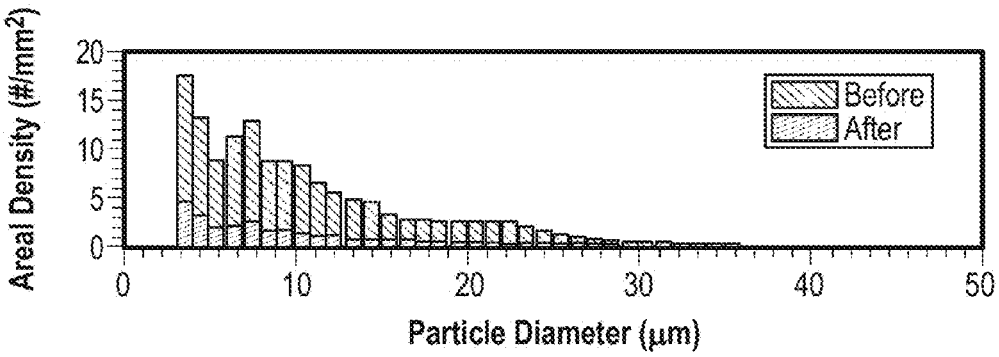
FIGS. 4 and 5 depict plots of particle removal performance for embodiments of electrostatically enhanced cleaning and/or polishing techniques.
Figure 4B:
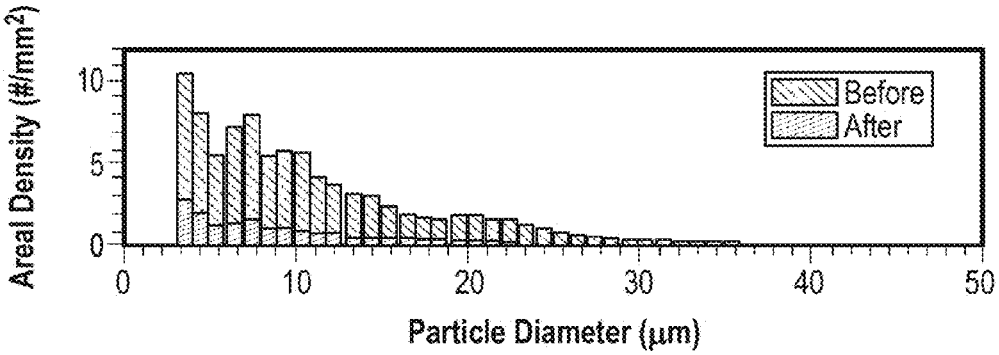
Figure 4C:
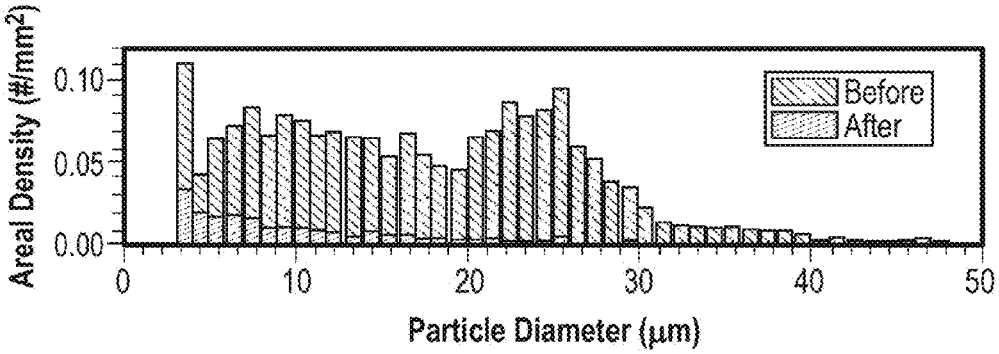

Histograms of the particle areal density versus particle size before and after the self-loaded ES enhanced process are shown in FIGS. 4A-C. These demonstrate that there was a substantial reduction in the particulate contamination by the self-loaded ES enhanced process. Without the application of the ES voltage, the tape is not touching the disk, and there would be no removal of particles. The friction force and the contamination particle areal density before and after the ES enhanced cleaning pass are listed in Table 1. The level of the friction force corresponds to an externally applied load force of about 100 grams (g), or about 50 g to about 150 g in other embodiments.

The first two sample disks were contaminated by exposure to ambient atmospheric particles, while the third sample disk was contaminated by twice polishing a thin layer of lubrication on the disk (e.g., 0.2 nm of ZTMD).

TABLE 1

| Disk Contaminated By: | Friction Force (g) | Particle Count Before Cleaning (particles/mm$^2$) | Particle Count After Cleaning (particles/mm$^2$) | Removal Efficiency (before/after) |
|---|---|---|---|---|
| Ambient Air | 141 | 148.1 | 33.35 | 4.4 |
| Ambient Air | 68 | 95.85 | 16.7 | 5.7 |
| Thin Lube, Twice Polished | 114 | 2.04 | 0.24 | 8.6 |

Example 2

External Loading Configuration

A bench top friction tester was set up to operate with the load externally applied to the Mylar back of the tape with a foam pad mounted on an air slide which was attached to an air cylinder. The externally loaded configuration (with ES voltage=0) is conventionally used in disk manufacturing. The ES charge electrode was positioned near the assembly as shown in FIG. 2. The disks were provided with nitrogenated diamond like carbon overcoats having thicknesses of about 3.8 nm, and lubricated with ZTMD having a thickness of about 1.2 nm. The particles on one side of each disk were measured with a Candela 6100 optical surface analyzer.

Figure 5A:
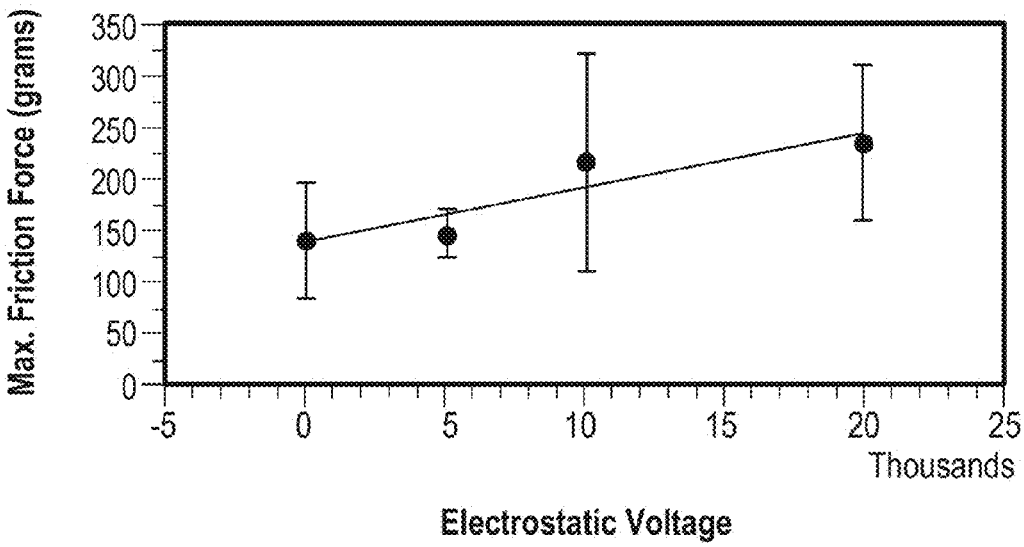
Figure 5B:
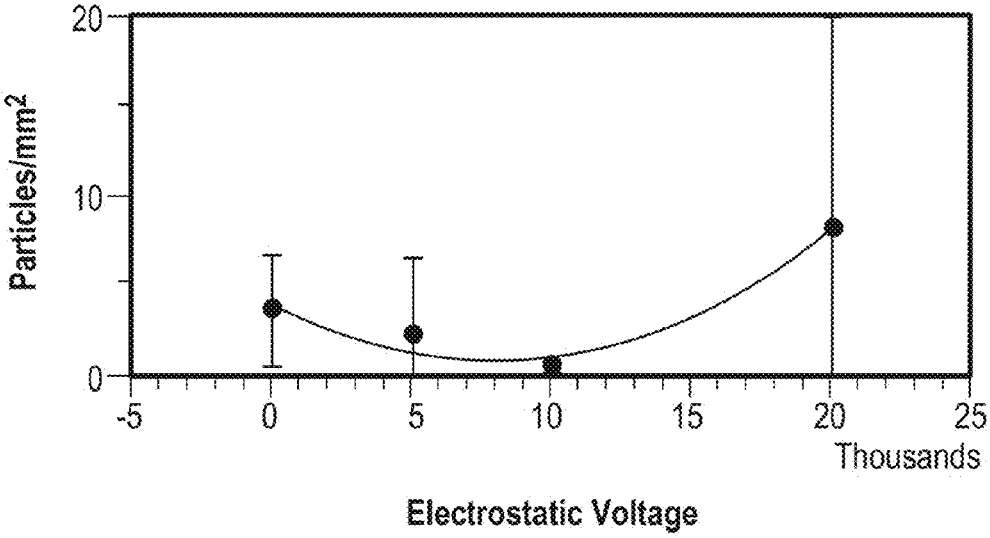

The maximum friction force during each test with several different values of ES voltage is shown in FIG. 5A. The application of ES voltage adds about 100 grams or more to the friction force at about 10 or 20 kV. The contamination particle density after the ES enhanced polishing sweep as a function of ES voltage is shown in FIG. 5B. The contamination particle area density was minimal at an ES voltage setting of about 10 kV. Other operating conditions include: a pad load of about 105 grams, a 3.8×10 mm soft elastomeric polishing pad, a 0.3 μm polishing tape with Benard cells, a linear velocity of about 2 m/sec, and a traverse rate of about 1.67 mm/sec.

Figure 6:
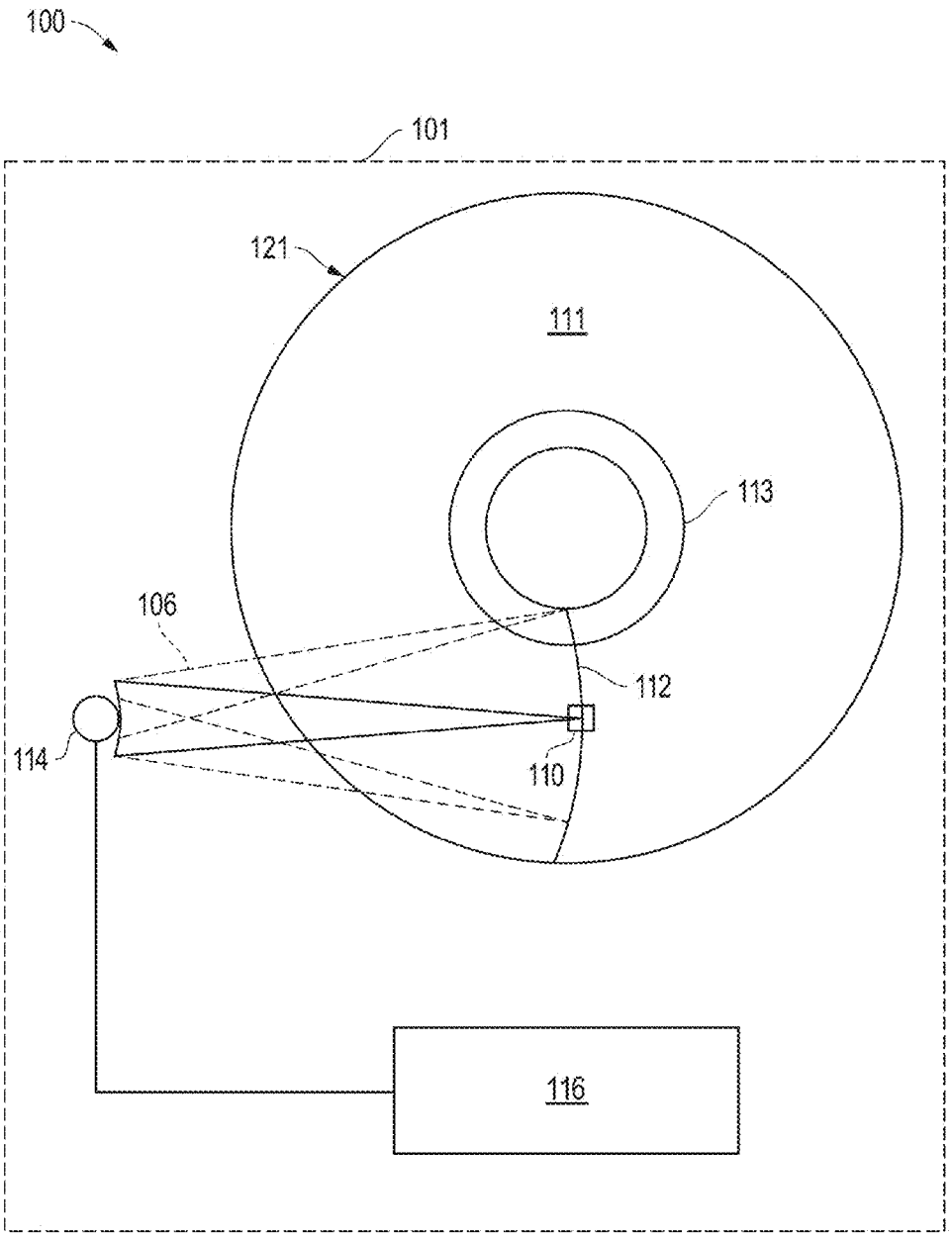
FIG. 6 is schematic plan view of an embodiment of a disk drive.

FIG. 6 depicts a hard disk drive assembly 100 comprising a housing or enclosure 101 with one or more media disks 111 rotatably mounted thereto. The disk 111 comprises magnetic recording media rotated at high speeds by a spindle motor (not shown) during operation. Concentric magnetic data tracks 113 are formed on either or both of the disk surfaces to receive and store information.

Embodiments of a read/write slider 110 may be moved across the disk surface by an actuator assembly 106, allowing the slider 110 to read and/or write magnetic data to a particular track 113. The actuator assembly 106 may pivot on a pivot 114. The actuator assembly 106 may form part of a closed loop feedback system, known as servo control, which dynamically positions the read/write slider 110 to compensate for thermal expansion of the magnetic recording media 111 as well as vibrations and other disturbances or irregularities. Also involved in the servo control system is a complex computational algorithm executed by a microprocessor, digital signal processor, or analog signal processor 116 that receives data address information from a computer, converts it to a location on the disk 111, and moves the read/write slider 110 accordingly.

In some embodiments of hard disk drive systems, read/write heads 110 periodically reference servo patterns recorded on the disk to ensure accurate slider 110 positioning. Servo patterns may be used to ensure a read/write slider 110 follows a particular track 113 accurately, and to control and monitor transition of the slider 110 from one track to another. Upon referencing a servo pattern, the read/write slider 110 obtains head position information that enables the control circuitry 116 to subsequently realign the slider 110 to correct any detected error.

Servo patterns or servo sectors may be contained in engineered servo sections 112 that are embedded within a plurality of data tracks 113 to allow frequent sampling of the servo patterns for improved disk drive performance, in some embodiments. In a typical magnetic recording media 111, embedded servo sections 112 may extend substantially radially from the center of the magnetic recording media 111, like spokes from the center of a wheel. Unlike spokes however, servo sections 112 form a subtle, arc-shaped path calibrated to substantially match the range of motion of the read/write slider 110.

In some embodiments, a method for cleaning or polishing magnetic recording media (MRM) may comprise mounting and rotating the MRM on a spindle; circulating a tape adjacent to a surface of the MRM; and applying an electrostatic (ES) voltage to the tape and attracting particles located on the MRM to the tape.

Figure 7:
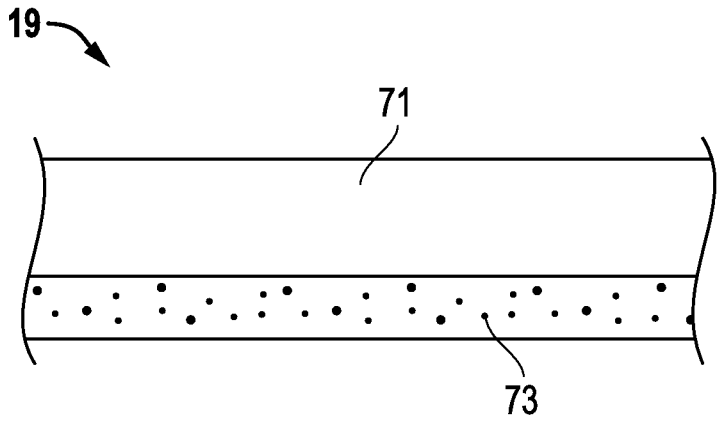
FIG. 7 is a schematic sectional side view of an embodiment of tape.

The ES voltage may apply an ES load to the tape to force the tape into contact with the surface of the MRM, and the ES load may be in a range of about 50 g to about 150 g. In some embodiments, no mechanical load is applied to the tape to force the tape into contact with the surface of the MRM, while in other embodiments a mechanical load is applied to the tape to force the tape into contact with the surface of the MRM. As shown in FIG. 7, the tape 19 may comprise a laminate having a layer 71 of MYLAR® or polyethylene terephthalate (PET), and the layer may have a thickness of about 25 μm to about 50 μm. The laminate may further comprise a coating 73 comprising a particle composite in a polymeric binder, and the coating has a thickness of about 5 μm to about 10 μM.

Figure 8:
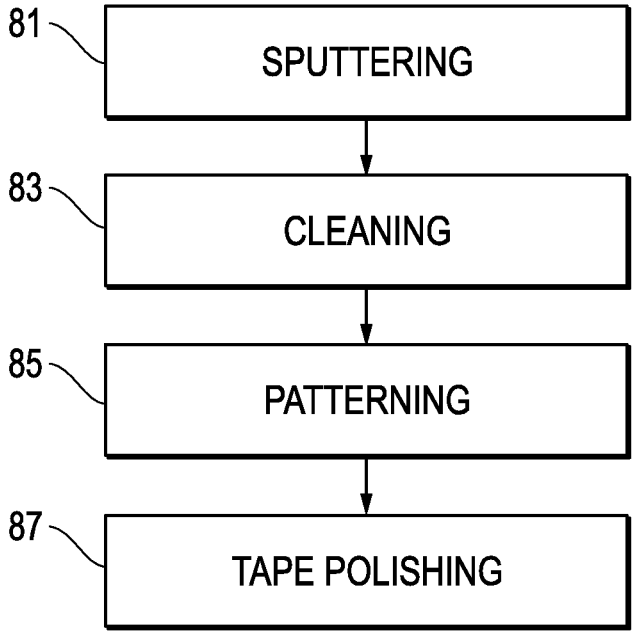
FIG. 8 is a flow diagram of an embodiment of a method of processing magnetic recording media.

In some embodiments (e.g., FIG. 8), the method comprises sputtering the disk 81, and cleaning 83 the MRM prior to discrete track or bit patterning 85 of photoresist. In other embodiments the method comprises final tape polishing (FTP) 87 the MRM. The spindle may comprise a spindle cap and bolt for securing the MRM to the spindle, and the spindle cap and bolt may be formed from an electrically insulative material to avoid grounding the ES voltage.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A method for cleaning or polishing magnetic recording media (MRM), comprising:

mounting and rotating the MRM on a spindle;

circulating a tape adjacent to a surface of the MRM; and applying an electrostatic (ES) voltage to the tape and attracting particles located on the MRM to the tape.

2. The method of claim 1, wherein the ES voltage applies an ES load to the tape to force the tape into contact with the surface of the MRM.

3. The method of claim 2, wherein the ES load is in a range of about 50 g to about 150 g.

4. The method of claim 1, wherein no mechanical load is applied to the tape to force the tape into contact with the surface of the MRM.

5. The method of claim 1, further comprising applying a mechanical load to the tape to force the tape into contact with the surface of the MRM.

6. The method of claim 1, wherein the tape comprises a laminate having a layer of polyethylene terephthalate (PET).

7. The method of claim 6, wherein the layer has a thickness of about 25 μm to about 50 μm.

8. The method of claim 6, wherein the laminate further comprises a coating comprising a particle composite in a polymeric binder, and the coating has a thickness of about 5 μm to about 10 μm.

9. The method of claim 1, further comprising sputtering the disk, and the steps comprise cleaning the MRM prior to discrete track or bit patterning of photoresist.

10. The method of claim 1, wherein the steps comprise final tape polishing (FTP) the MRM.

11. The method of claim 1, wherein the spindle comprises a spindle cap and bolt for securing the MRM to the spindle, and the spindle cap and bolt are formed from an electrically insulative material to avoid grounding the ES voltage.

12. A method for cleaning or polishing magnetic recording media (MRM), comprising:

mounting and rotating the MRM on a spindle;

circulating a tape adjacent to a surface of the MRM;

applying an electrostatic (ES) voltage to the tape such that only an ES load forces the tape into contact with the surface of the MRM, and no mechanical load is applied to the tape to force the tape into contact with the surface of the MRM; and attracting particles located on the MRM to the tape.

13. The method of claim 12, wherein the ES load is in a range of about 50 g to about 150 g.

14. The method of claim 12, wherein the tape comprises a laminate having a layer of MYLAR® or polyethylene terephthalate (PET), and the layer has a thickness of about 25 μm to about 50 μm.

15. The method of claim 14, wherein the laminate further comprises a coating comprising a particle composite in a polymeric binder, and the coating has a thickness of about 5 μm to about 10 μm.

16. The method of claim 12, further comprising sputtering the disk, and the steps comprise cleaning the MRM prior to discrete track or bit patterning of photoresist.

17. The method of claim 12, wherein the steps comprise final tape polishing (FTP) the MRM.

18. The method of claim 12, wherein the spindle comprises a spindle cap and bolt for securing the MRM to the spindle, and the spindle cap and bolt are formed from an electrically insulative material to avoid grounding the ES voltage.

19. A method for final tape polishing (FTP) magnetic recording media (MRM), comprising:

mounting and rotating the MRM on a spindle;

circulating a tape adjacent to a surface of the MRM;

applying an electrostatic (ES) voltage to the tape such that only an ES load forces the tape into contact with the surface of the MRM, and no mechanical load is applied to the tape to force the tape into contact with the surface of the MRM;

final tape polishing the MRM; and attracting particles located on the MRM to the tape.

20. The method of claim 19, wherein the ES load is in a range of about 50 g to about 150 g.

21. The method of claim 19, wherein the tape comprises a laminate having a layer of polyethylene terephthalate (PET), and the layer has a thickness of about 25 μm to about 50 μm.

22. The method of claim 19, wherein the laminate further comprises a coating comprising a particle composite in a polymeric binder, and the coating has a thickness of about 5 μm to about 10 μm.

23. The method of claim 19, wherein the spindle comprises a spindle cap and bolt for securing the MRM to the spindle, and the spindle cap and bolt are formed from an electrically insulative material to avoid grounding the ES voltage.

* * * * *